US007632191B2

(12) United States Patent
Zambelli et al.

(10) Patent No.: US 7,632,191 B2
(45) Date of Patent: Dec. 15, 2009

(54) SEAT FOR AMUSEMENT APPARATUS

(75) Inventors: Giambattista Zambelli, Ceneselli (IT); Alberto Zamperla, Vicenza (IT)

(73) Assignee: Antonio Zamperla S.p.A., Vicenza (IT)

( * ) Notice: Subject to any disclaimer, the term of this patent is extended or adjusted under 35 U.S.C. 154(b) by 948 days.

(21) Appl. No.: 10/726,830

(22) Filed: Dec. 3, 2003

(65) Prior Publication Data

US 2005/0001466 A1 Jan. 6, 2005

(30) Foreign Application Priority Data

Jun. 10, 2003 (IT) ..... MI2003 A 001166

(51) Int. Cl.
*A63G 1/34* (2006.01)
*A63G 1/22* (2006.01)

(52) U.S. Cl. ..... 472/43; 472/47; 297/357

(58) Field of Classification Search ..... 472/59, 472/60, 43, 36, 37; 434/55, 29, 247, 255; 297/357, 366, 484, 215.12; 280/304.4
See application file for complete search history.

(56) References Cited

U.S. PATENT DOCUMENTS

| | | | | |
|---|---|---|---|---|
| 553,722 | A | 1/1896 | Moeri | |
| 2,005,400 | A | 6/1935 | Stoehrer et al. | |
| 3,006,642 | A | 10/1961 | Bartlett | |
| D226,931 | S | 5/1973 | Wormser | |
| 3,993,304 | A | 11/1976 | Ahrens | |
| 4,313,639 | A * | 2/1982 | Ware | 297/366 |
| 4,531,459 | A | 7/1985 | Yamada | |
| 4,548,136 | A | 10/1985 | Yamada | |
| D366,513 | S | 1/1996 | Crowe et al. | |
| D382,324 | S | 8/1997 | Shinzato | |
| 5,827,123 | A | 10/1998 | Reverchon | |
| 5,833,544 | A | 11/1998 | Corbin et al. | |
| 5,887,943 | A | 3/1999 | Lee | |
| 5,979,333 | A | 11/1999 | Houben et al. | |
| 6,206,399 | B1 | 3/2001 | Schnitzenbaumer | |
| 6,287,211 | B1 | 9/2001 | Bolliger et al. | |
| 6,568,699 | B2 | 5/2003 | McCann | |
| 6,884,177 | B2 | 4/2005 | Zambelli et al. | |
| 6,971,316 | B2 | 12/2005 | Hansen et al. | |

(Continued)

FOREIGN PATENT DOCUMENTS

DE 202 17 754 2/2002

(Continued)

OTHER PUBLICATIONS

FKF Awared 2004, Vekoma Rides Manufacturing B.V., 1 page.

(Continued)

*Primary Examiner*—Kien T Nguyen
(74) *Attorney, Agent, or Firm*—Kenyon & Kenyon LLP

(57) ABSTRACT

A seat for amusement apparatus, unusually suitable for allowing the user to adopt a new position on the apparatus, comprising a support and means for immobilising the user on the support. The immobilising means comprise at least one support in front of the user and opposing means suitable for acting on the user's back. The opposing means comprises an arm which can move between a lowered position in which the user can sit down on the support and a raised position in which one end of the arm abuts against the user's back.

48 Claims, 11 Drawing Sheets

U.S. PATENT DOCUMENTS

| | | | |
|---|---|---|---|
| 6,976,923 | B1 | 12/2005 | Clarke et al. |
| 6,983,992 | B2 | 1/2006 | Oomori |
| 2002/0070599 | A1 | 6/2002 | Berra |
| 2004/0032157 | A1 | 2/2004 | Trimborn |
| 2005/0175968 | A1 | 8/2005 | Milner |
| 2006/0063137 | A1 | 3/2006 | Robbins |

FOREIGN PATENT DOCUMENTS

| | | |
|---|---|---|
| EP | 1 215 091 | 6/2002 |
| WO | 2004/073818 | 9/2004 |

OTHER PUBLICATIONS

Motorbike Coaster, http://www.vekoma.corn/rides__fam__coasters/motorbike__coaster.htm, printed on Mar. 10, 2006, 1 page.

Motobike Coaster, Family Coasters, Vekoma Rides Manufacturing B.V., 2 pages.

International Search Report dated Aug. 11, 2005, Application No. PCT/EP2005/006251, filed Jun. 10, 2005.

Prestigious IAAPA "Best New Product Award" for Vekoma Rides Manufacturing, IAAPA Orlando 2004 Award Winner, 1 page.

Booster Bike, Vekoma Rides Manufacturing and Toverland, www.rcdb.com/document122.htm, printed on Apr. 12, 2006.

Werner, "How to Ride a Motorcycle—and not get caught!", www.motorbiker.org/blogs.nsf/dx/11082004193615MWEPTQ.htm, printed on Apr. 12, 2006.

* cited by examiner

SEAT FOR AMUSEMENT APPARATUS

FIELD OF THE INVENTION

This invention relates to a seat for amusement apparatus.

BACKGROUND OF THE INVENTION

In amusement apparatus the user or passenger is generally seated on a suitable seat. For reasons of safety the seat is often provided with means for immobilising the user on the support of the seat in such a way that the user is firmly held in his seat despite the movements performed by the amusement apparatus.

A seat for amusement apparatus comprising a fixed back and a fork hinged on the back above the user is for example known. The fork descends and immobilises the user's shoulders and chest against the fixed back.

A seat having this configuration immobilises the user on the support of the seat, ensuring his safety, but does not allow the spectator to make movements of any kind, thus for example diminishing the ride sensation provided by the amusement apparatus, or one of the sensations which it is attempted to generate in order to render the amusement apparatus exciting.

The need to construct amusement apparatus which can generate new sensations for users has always been felt within the sector. This requirement may for example be satisfied through the design of new seats which allow the user to adopt new positions and attitudes with respect to the apparatus.

The problem underlying this invention is that of providing a seat for amusement apparatus which has structural and functional characteristics such as to distinguish it from the known art and to allow the user to adopt new positions on the apparatus.

SUMMARY OF THE INVENTION

This problem is resolved through a seat for amusement apparatus of the type specified above according to claim 1.

BRIEF DESCRIPTION OF THE DRAWINGS

Other advantages and characteristics of the present invention will become clear from the following detailed description which is given with reference to the appended drawings which are provided purely by way of non-limiting example and in which.

DETAILED DESCRIPTION OF THE INVENTION

With reference to the abovementioned figures, a seat for amusement apparatus is indicated as a whole by 10.

As the appended figures illustrate, seat 10 is advantageously constructed in such a way that the passenger or user sits astride the same, adopting a posture similar to that adopted by motorcyclists.

In addition to this the structure of the seat is such as to leave the passenger's shoulders free, securing him in the vicinity of the chest or abdomen.

According to a possible embodiment seat 10 comprises a support 12 supported by a frame 14. For example support 12 is in the shape of a saddle or motor vehicle seat so as to receive the passenger sitting astride the same.

According to a possible embodiment frame 14 is for example constructed of a set of tubular members, although other embodiments such as compact and boxed structures are possible.

Figure 6:
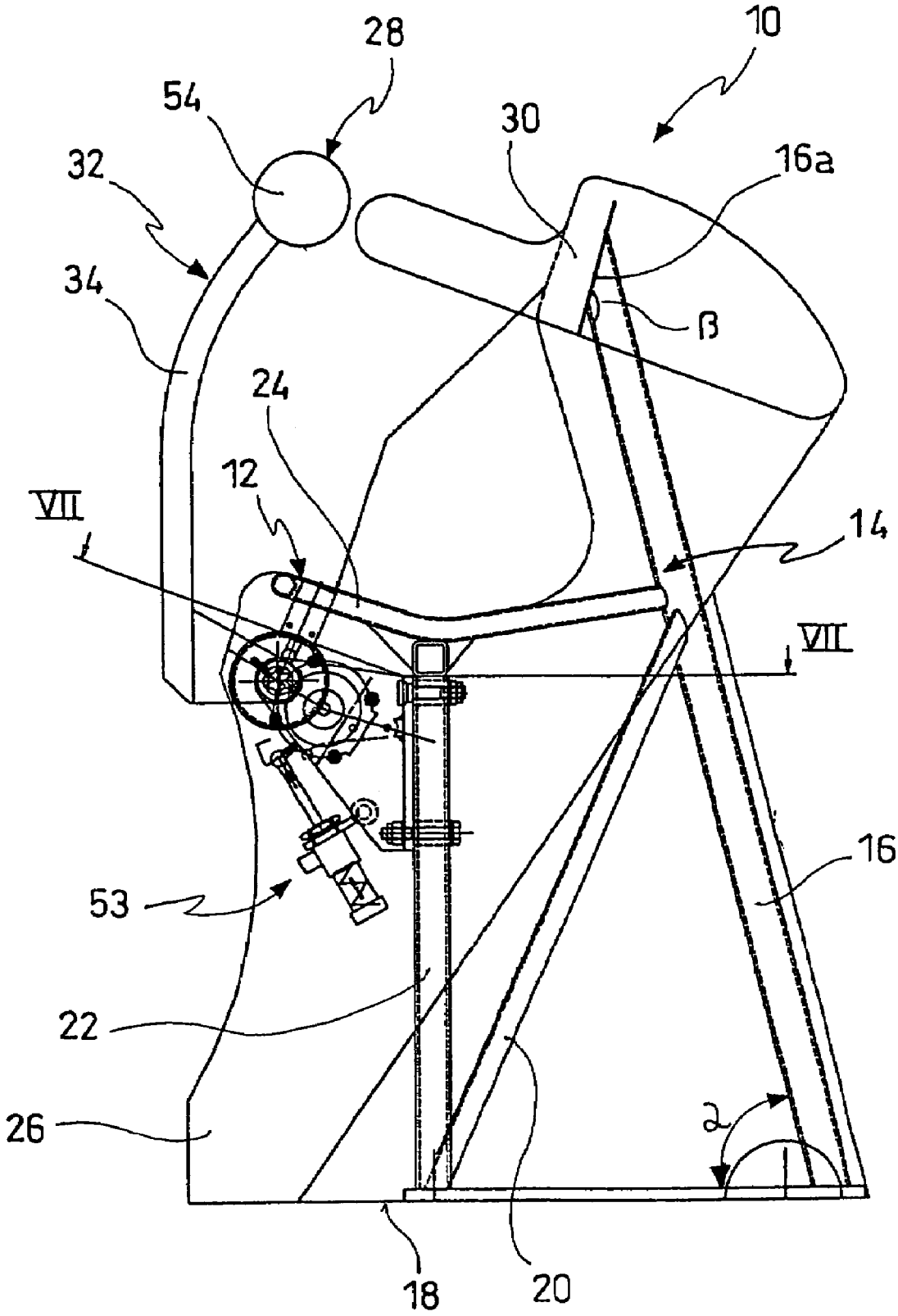
FIG. 6 illustrates a side view of the seat in FIG. 1.

FIG. 6 illustrates an embodiment of frame 14 in which frontal supporting member 16 is fixed to a floor 18. Frontal supporting member 16 extends from floor 18 preferably in a direction which is inclined at an angle of $\alpha$ with respect to the floor.

The extremity of the frontal supporting member opposite floor 18 ends in a portion **16*a* which is preferably inclined at an angle $\beta$ with respect to the frontal supporting member. Portion 16*a*** is suitable for supporting a cushion to support the passenger, which is for example manufactured from polyurethane.

Two lateral supporting members 20 extend from frontal supporting member 16 and floor 18. Further supporting members 22 extend in a direction substantially perpendicular to floor 18 and constitute a support for supporting members 24 for support 12.

A cover or casing 26 completely encloses frame 14 of seat 10.

28 indicates means for immobilising the user on support 12 of the seat. These immobilising means advantageously comprise at least one support 30 mounted at the end of frontal supporting member 16 in the vicinity of portion **16*a*. Support 30 is located frontally with respect to the user and according to a possible embodiment has a shape such as to wrap round the passenger both at the front and at the side. For example support 30 comprises a central portion 30*a* which may comprise a supporting member for a frontal portion of the user, for example the chest in the case of children or the abdomen in the case of adults. Advantageously two side portions 30*b*, which are preferably arched, are also provided and extend from central portion 30*a*** and have a configuration such as to surround the passenger laterally.

Figure 1:
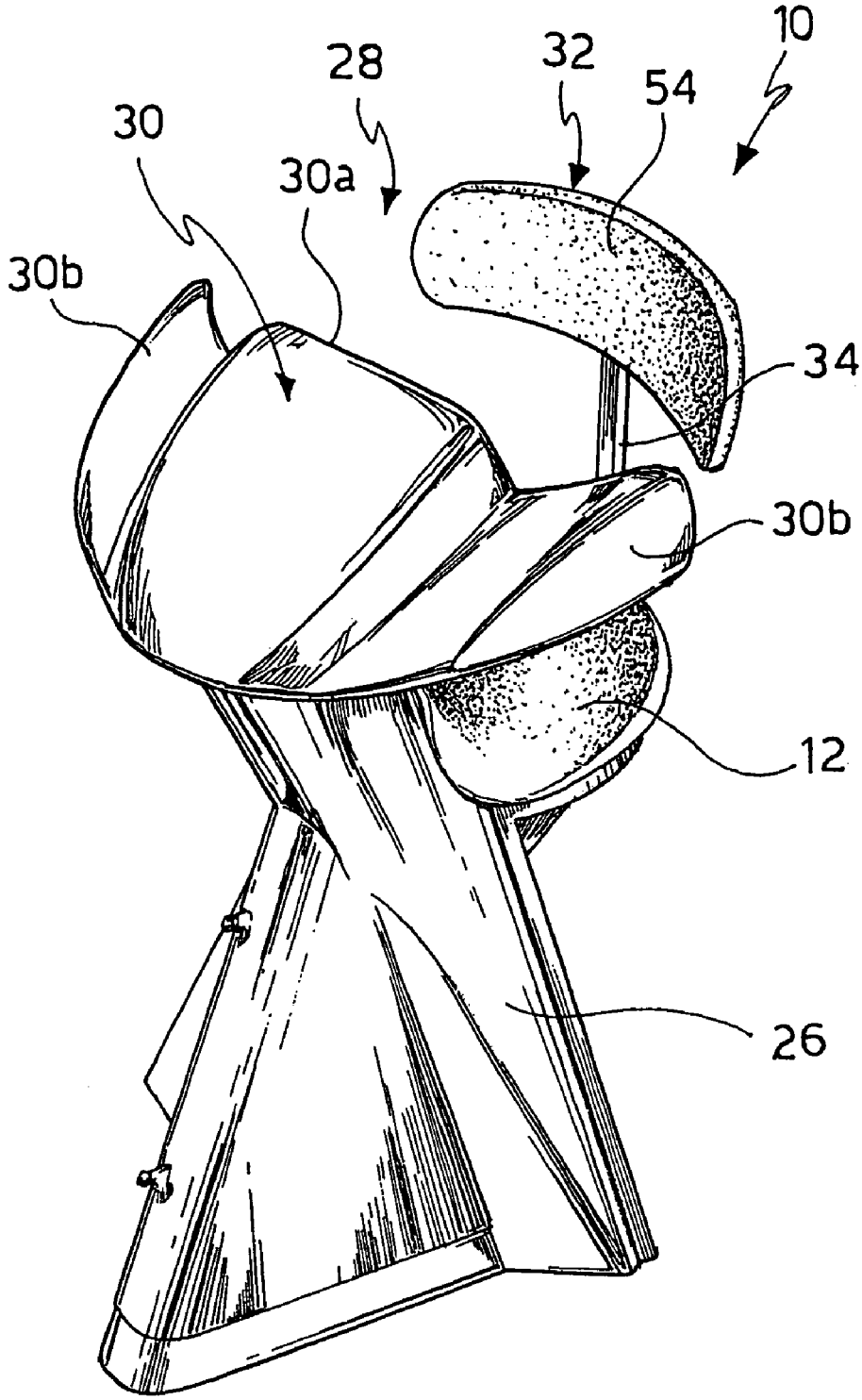
FIG. 1 illustrates a perspective view of the seat according to this invention.
Figure 2:
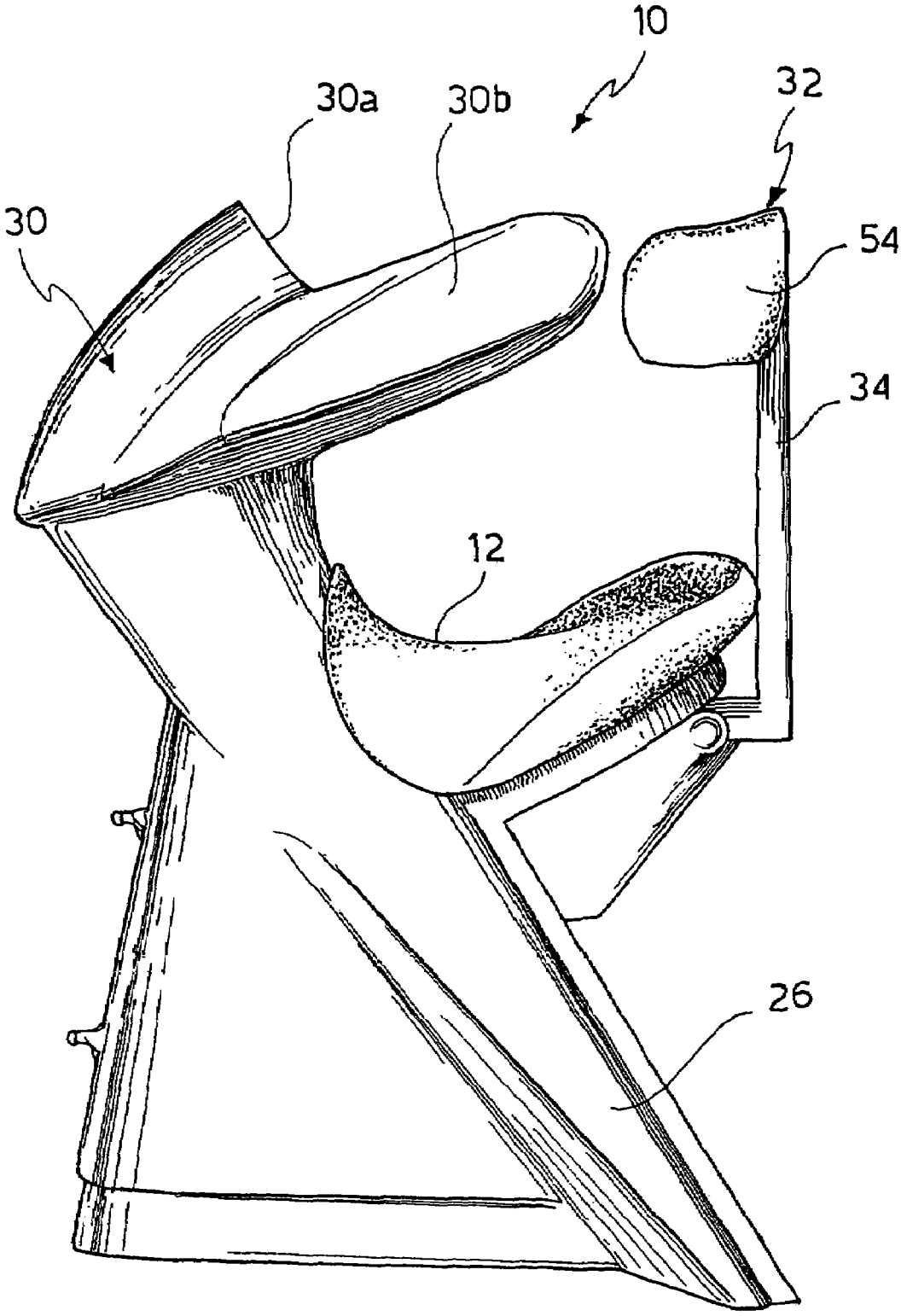
FIG. 2 illustrates a side view of the seat in FIG. 1.
Figure 3:
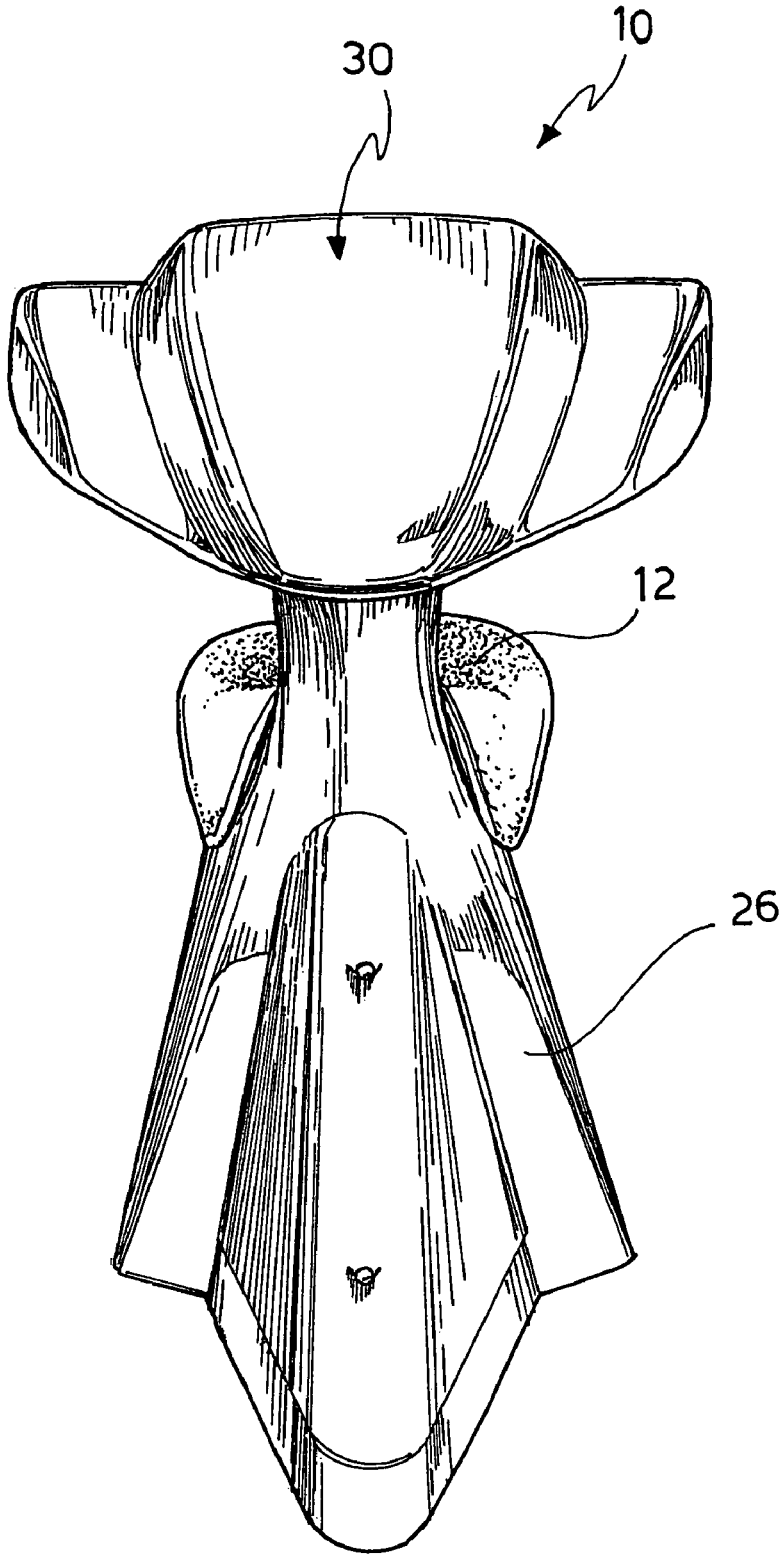
FIG. 3 illustrates a frontal view of the seat in FIG. 1.
Figure 4:
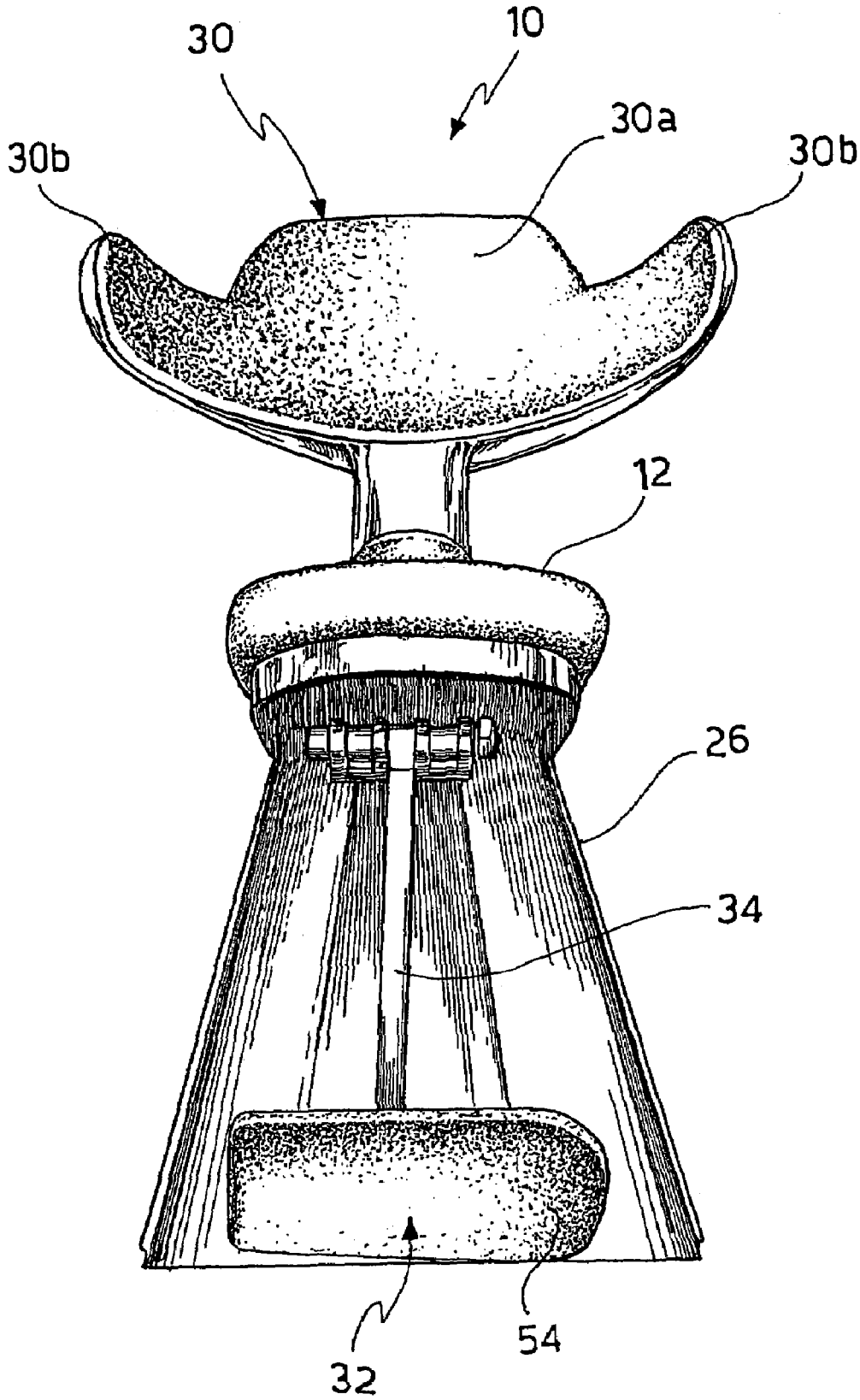
FIG. 4 illustrates a rear view of the seat in FIG. 1.
Figure 5:
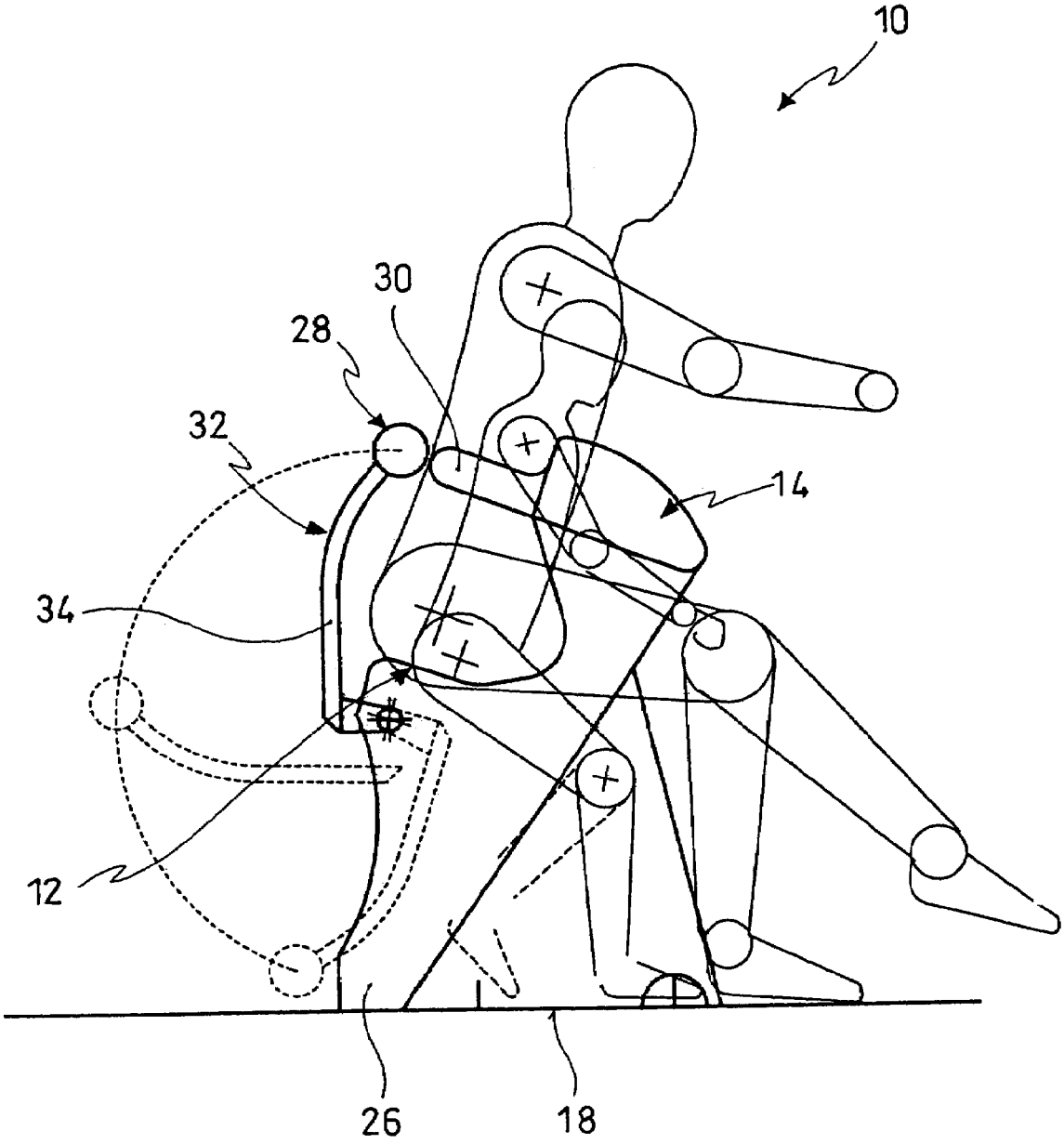
FIG. 5 illustrates a side view of the seat in FIG. 1 illustrating the position of the user, whether a child or an adult.

Immobilising means 28 advantageously also comprise opposing means 32 suitable for acting against the user's back. According to a possible embodiment the opposing means can move between an open position and a closed position in which it abuts against the user's back. FIG. 5 illustrates three positions of the opposing means corresponding to the open position (lowered position illustrated by a dashed line), the closed position (raised position illustrated by the unbroken line) and a position intermediate between the open position and the closed position (illustrated by a dashed line).

According to a possible embodiment, which is for example illustrated in the figures, opposing means 32 comprises an arm 34 which can move between a lowered position in which the user can sit down on the support of the seat and a raised position in which one end of the arm abuts against the user's back (FIG. 5). Preferably arm 34 is suitable for rotating with respect to support 12 and is operatively associated with a rotating actuator 36. According to possible embodiments actuator 36 may be of the pneumatic, hydraulic or electrical type.

According to a possible embodiment one end of arm 34 is keyed onto a splined shaft 38 mounted on frame 14.

Figure 7:
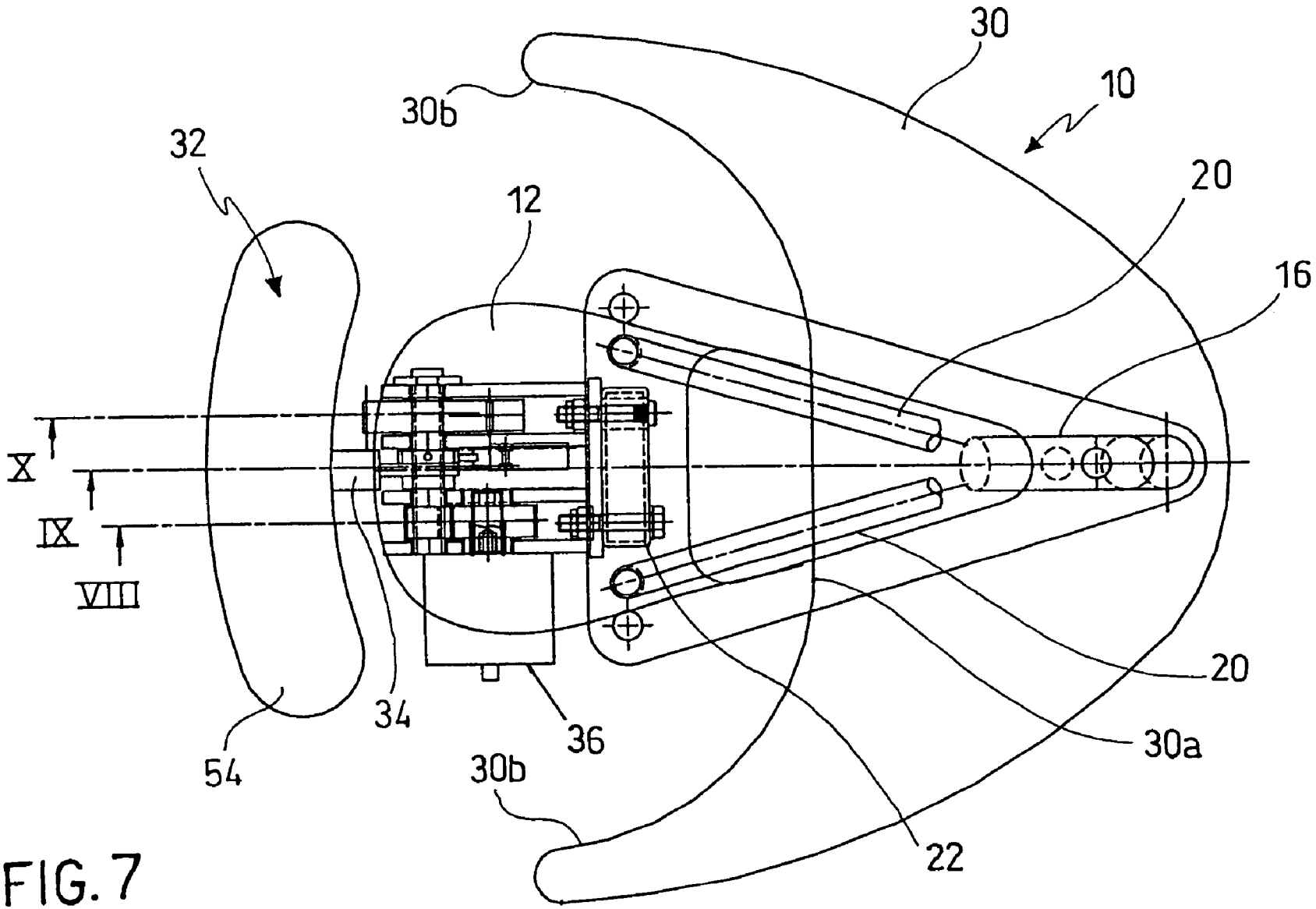
FIG. 7 illustrates a view of the seat in FIG. 1 from above in which some components are in cross-section along the line VII-VII in FIG. 6.
Figure 8:
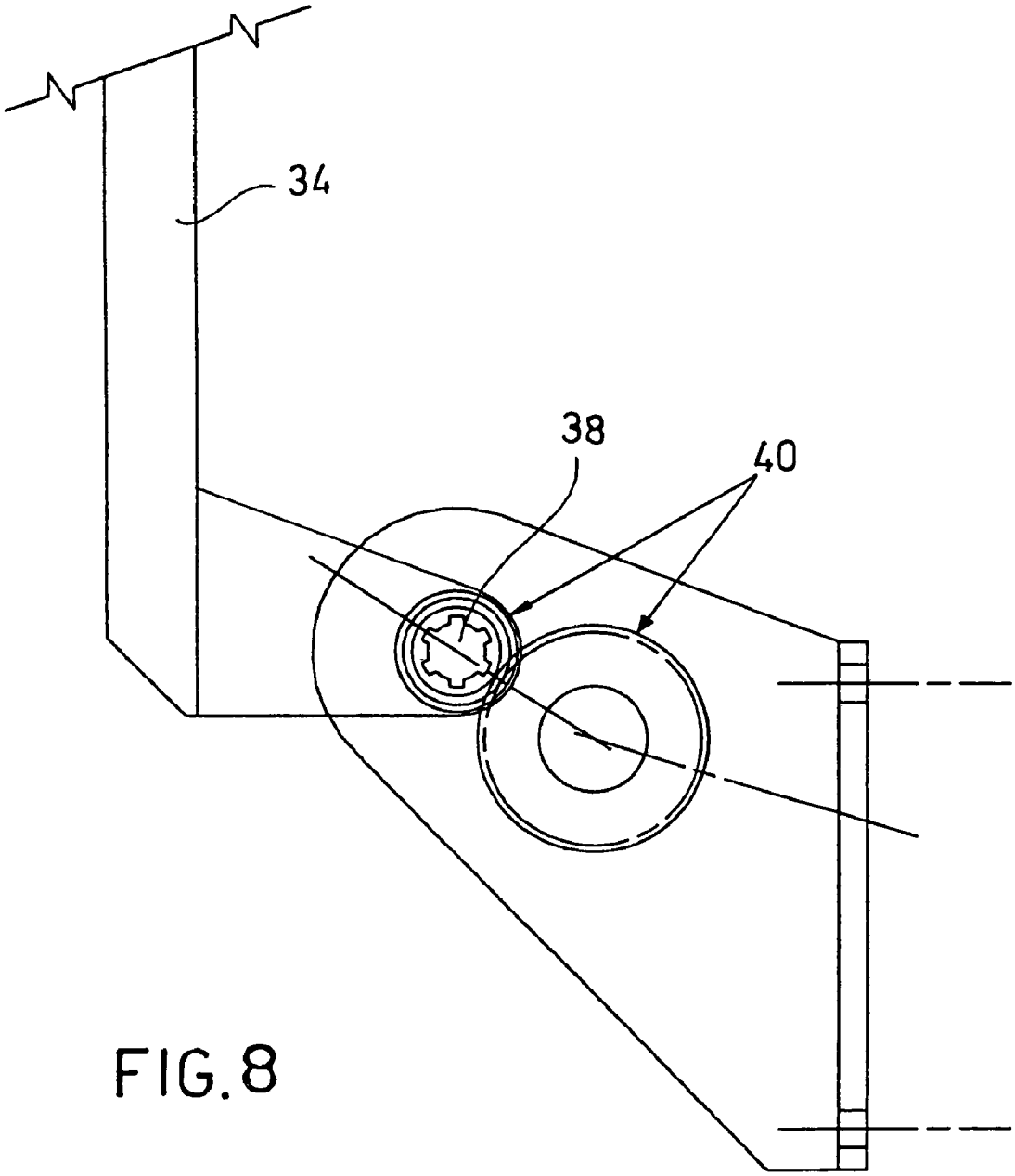
FIG. 8 illustrates a view of a detail in FIG. 7 in cross-section along the line VIII-VIII.

A gear 40 is suitable for being caused to rotate by rotating actuator 36 and transmit the motion to splined shaft 38 (FIGS. 7 and 8).

Figure 9:
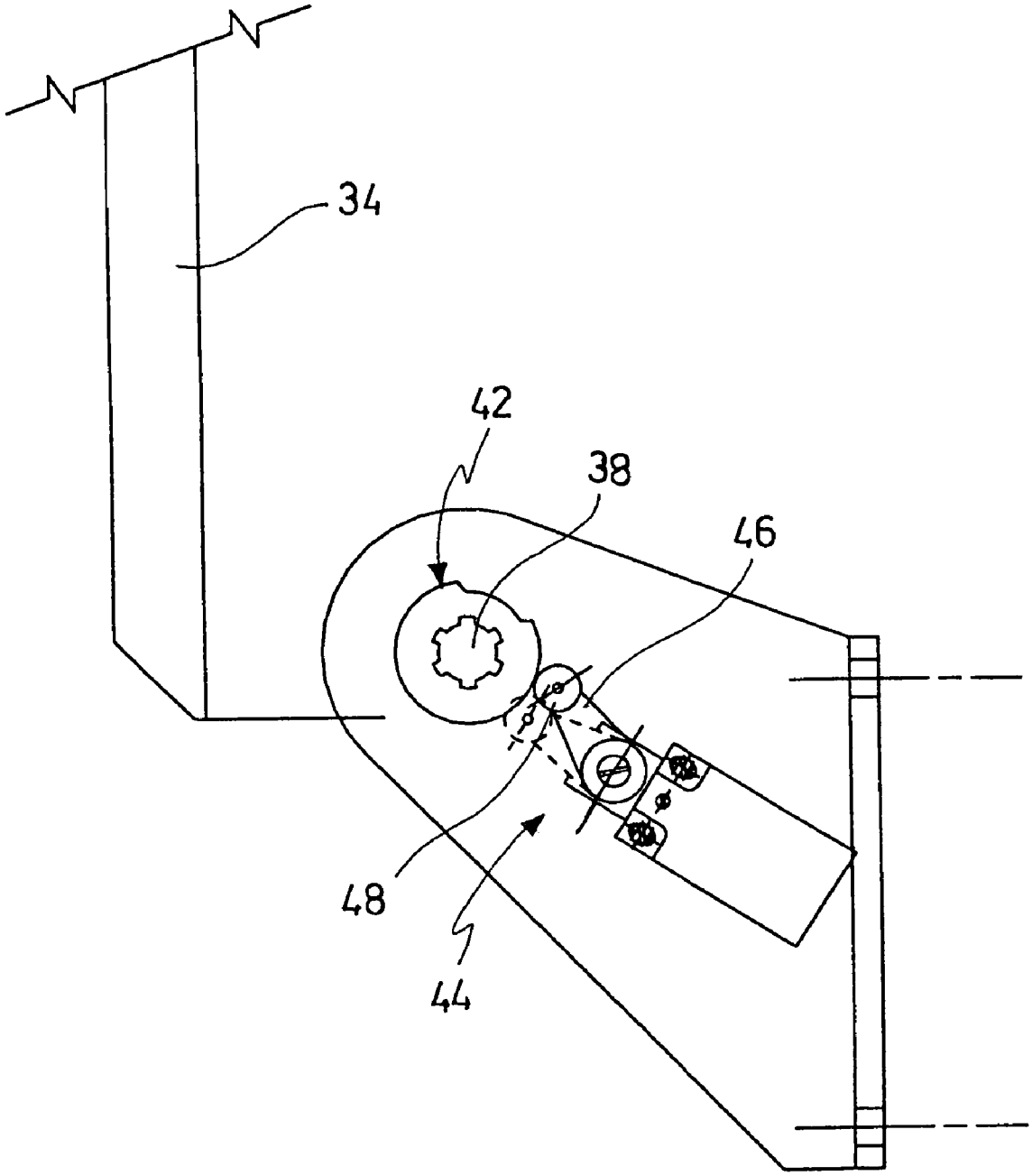
FIG. 9 illustrates a view of a detail in FIG. 7 in cross-section along the line IX-IX.

According to a possible embodiment arm 34 is operatively associated with a cam 42 and a microswitch 44 preferably through splined shaft 38 (FIG. 9) with the function of checking that the opposing means has passed beyond a particular vertical position so as to ensure that the passenger is held.

According to a possible embodiment cam 42 has a first circular profile which extends over approximately three quarters of the total perimeter of the cam and a second circular profile of smaller radius than the first circular profile which extends over approximately one quarter of the total perimeter of the cam. The two profiles are suitably connected.

According to a possible embodiment microswitch 44 comprises a runner 46 which is hinged to a body of the microswitch and is provided at one end with a small wheel 48 which rotates with respect to the runner and can move over the profile of cam 42.

Figure 10:
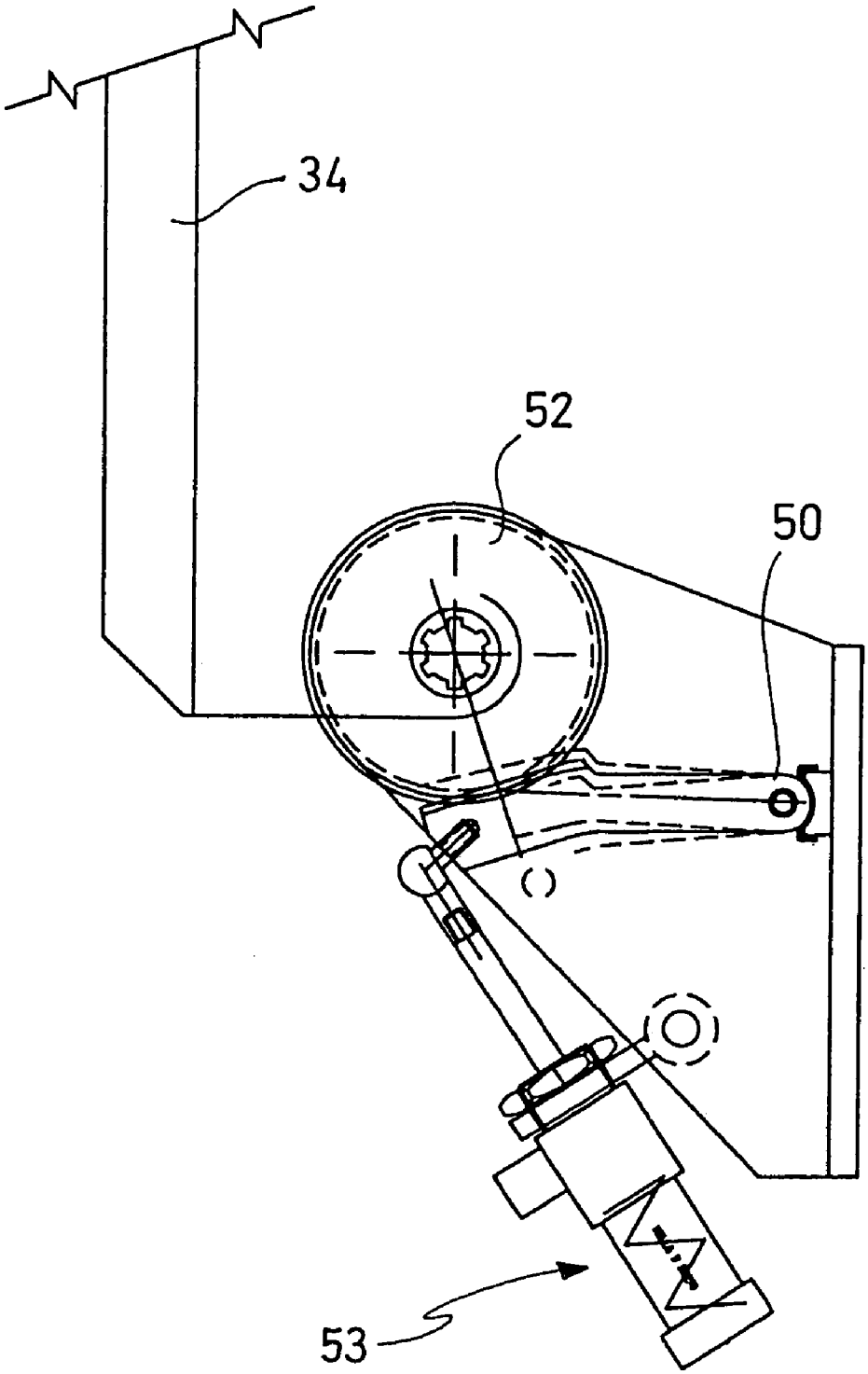
FIG. 10 illustrates a view of a detail in FIG. 7 in cross-section along the line X-X.

According to a possible embodiment arm 34 is operatively associated with means for immobilising it in the raised position, for example comprising a rack 50 hinged on frame 14. In particular the rack is associated with a toothed wheel 52 keyed onto splined shaft 38 to mechanically immobilise the opposing means in the raised position when it has reached the position in which it supports the passenger (FIGS. 7 and 10). Rack 50 and toothed wheel 52 therefore comprise immobilising means of the mechanical type to prevent movement of the opposing means either as a result of the movements of the amusement apparatus or the thrust of the passenger against the opposing means, preventing the passenger from being thrown out of the seat.

According to a possible embodiment rack 50 is kept in contact with and in mesh with toothed wheel 52, activated for example by a single-action pneumatic piston. In particular rack 50 is held against toothed wheel 52 by resilient means which can be disabled, for example pneumatically, during the return movement of the opposing means.

According to a possible embodiment, one end 54 of arm 34 can wrap partly round the user's back.

The manner in which the seat for amusement apparatus as described above is used is described below.

The user, whether a child or an adult, sits astride support 12 substantially as on a motor cycle and rests his chest or abdomen against support 30.

On the command of an operator actuator 36 causes splined shaft 38 and therefore arm 34 to rotate until the latter abuts against the user's back. Cam 42 and microswitch 44 constitute a control for the position of arm 34. In particular the profile of cam 42 moves with respect to small wheel 48 causing runner 46 to rotate about the hinge point (the dashed and unbroken line in FIG. 9).

Rack 50 meshes with toothed wheel 52 and keeps the arm immobilised in the raised position thus opposing the movements of the amusement apparatus and the thrust from the passenger, thus preventing the passenger from leaving the seat.

To release the passenger single-acting piston 53 compresses the spring which maintains contact between rack 50 and toothed wheel 52 while actuator 36 causes arm 34 to make its return travel.

Figure 11:
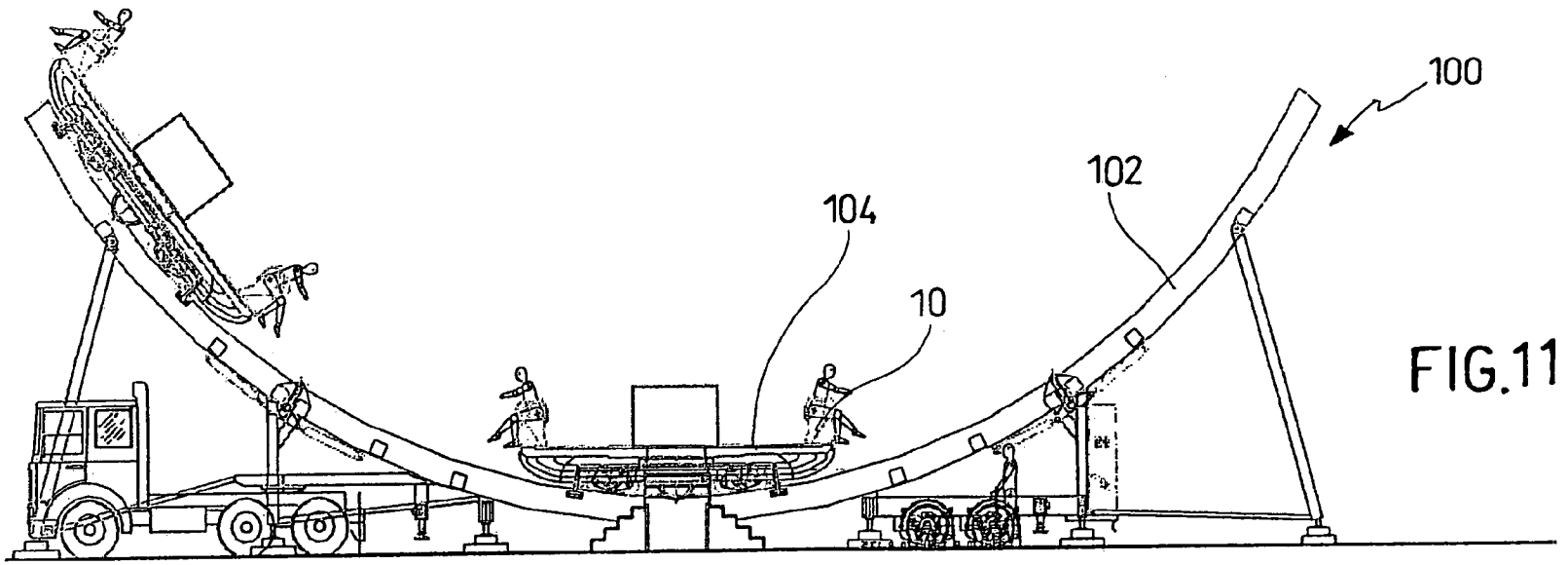
FIG. 11 illustrates a side view of amusement apparatus comprising a seat according to this invention.
Figure 12:
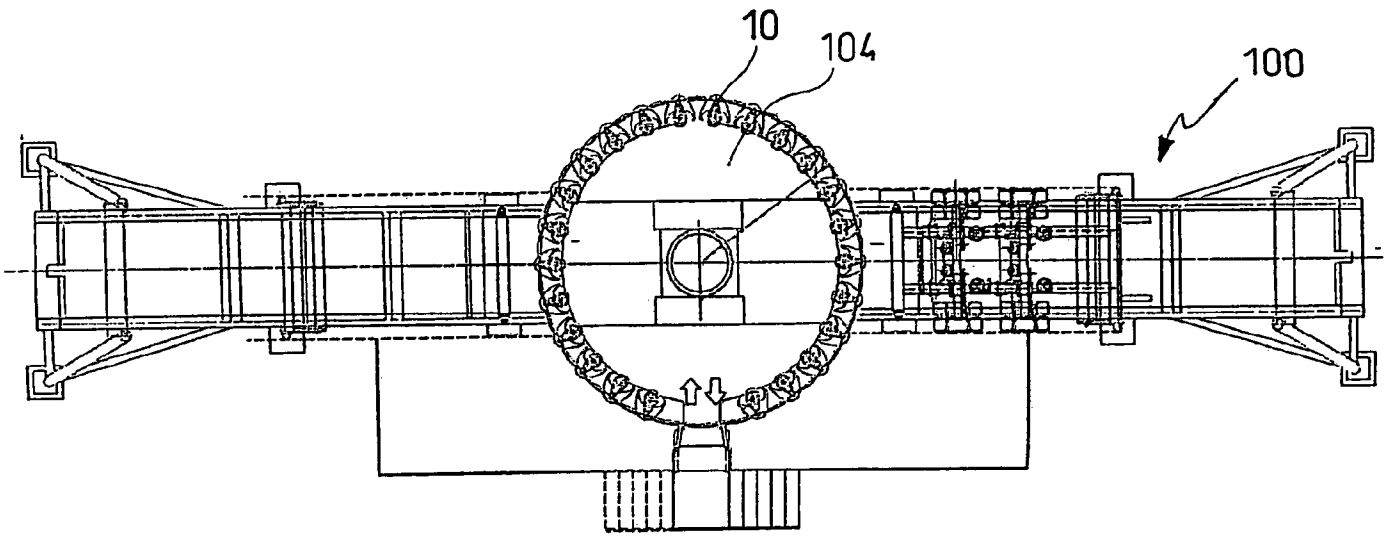
FIG. 12 illustrates a view of the amusement apparatus in FIG. 11 from above.

A possible embodiment of apparatus provided with seats according to this invention is illustrated in FIGS. 11 and 12. 100 indicates the apparatus as a whole comprising at least one track 102 on which a platform 104 can move. Platform 104 is mounted in such a way that it can rotate about an axis, for example an axis substantially perpendicular to the plane defined by the platform.

At least one set of seats 10 is mounted on a substantially perimetral portion of the platform, preferably in such a way that the user faces outwards from the platform.

The motion to which the user is subjected is the combination of the rotatory motion and the oscillatory motion of the platform. Provision may also be made for movement of the seats with respect to the platform.

From what has been stated above it will be appreciated that the provision of a seat for amusement apparatus according to this invention makes it possible to satisfy the requirement for obtaining a different position of the user on the apparatus, changing the sensations provoked in the user without the need for any drastic modification in the structure of the apparatus.

In particular the seat according to this invention leaves the user's shoulders free and allows him to adopt a position similar to that adopted by motorcyclists.

It is clear that variants and/or additions may be provided to what has been described and illustrated above.

Regardless of the embodiment, provision is advantageously made for the opposing means to rotate or move laterally with respect to the support.

According to a possible embodiment, the motion of the opposing means, and in particular the arm, can be brought about by means other than those described and illustrated. For example arm 34 may have a substantially circular shape with one toothed side suitable for meshing with a toothed wheel driven by the actuator.

As an alternative to what is illustrated in the appended figures, the frontal support may be movably mounted on the seat so that its position can be adjusted according to the user's dimensions. In this case a continuous adjustment or a stepwise adjustment may be provided, or movement may be permitted to assist access from the side.

According to a possible embodiment the seat may be substantially reversed with the provision of a movable frontal support and a fixed rear support. In each case the passenger sits astride the seat with his shoulders free. The frontal support may rotate or move linearly.

In order to satisfy specific contingent requirements a person skilled in the art may make many modifications, adaptations and substitutions of components with other functional equivalents to the preferred embodiment of the seat for amusement apparatus described above without however going beyond the scope of the following claims.

We claim:

1. Seat for amusement apparatus comprising a support and means for immobilizing the user on the support, wherein the immobilizing means are suitable for leaving the passenger's shoulders free and immobilizing him through an abdominal or thoracic portion and wherein the support is shaped so as to receive the passenger astride the seat;

wherein the immobilizing means comprise at least one frontal support with respect to a user and opposing means designed to act on the user's back; and wherein the opposing means can move between an open position and a closed position in which it abuts against the user's back.

2. Seat according to claim 1, in which the front support is mounted to move on the seat so that its position can be adjusted according to the user's dimensions.

3. Seat according to claim 1, in which the opposing means is suitable for moving laterally with respect to the support.

4. Amusement apparatus comprising a platform which can move on at least one track, said platform comprising at least one seat according to one of claims from 1 to 3.

5. Amusement apparatus according to claim 4, in which the platform is circular.

6. Amusement apparatus according to claim 4, in which the platform comprises a plurality of seats arranged on at least one peripheral portion of the platform.

7. Amusement apparatus according to claim 4, in which the at least one seat is position in such a way that the passenger faces outwards from the platform.

8. Seat for amusement apparatus comprising a support and means for immobilizing the user on the support, wherein the immobilizing means are suitable for leaving the passenger's shoulders free and immobilizing him through an abdominal or thoracic portion and wherein the support is shaped so as to receive the passenger astride the seat;

wherein the immobilizing means comprise at least one frontal support with respect to a user and opposing means designed to act on the user's back; and wherein the opposing means comprises an arm which can move between a lowered position in which the user can site down on the support and a raised position in which one end of the arm abuts against the user's back.

9. Seat according to claim 8, in which the arm is suitable for rotating with respect to the support.

10. Seat according to claim 9, in which the arm is operatively associated with a rotating actuator.

11. Seat according to claim 8, in which one extremity of the arm is suitable for wrapping partly round the back of the user.

12. Seat for amusement apparatus comprising a support and means for immobilizing the user on the support, wherein the immobilizing means are suitable for leaving the passenger's shoulders free and immobilizing him through an abdominal or thoracic portion and wherein the support is shaped so as to receive the passenger astride the seat;

wherein the immobilizing means comprise at least one frontal support with respect to a user and opposing means designed to act on the user's back;

wherein the opposing means comprises an arm which can move between a lowered position in which the user can sit down on the support and a raised position in which one end of the arm abuts against the user's back;

wherein the arm is suitable for rotating with respect to the support; and wherein the arm is operatively associated with a linear actuator.

13. Seat for amusement apparatus comprising a support and means for immobilizing the user on the support, wherein the immobilizing means are suitable for leaving the passenger's shoulders free and immobilizing him through an abdominal or thoracic portion and wherein the support is shaped so as to receive the passenger astride the seat;

wherein the immobilizing means comprise at least one frontal support with respect to a user and opposing means designed to act on the user's back;

wherein the opposing means comprises an arm which can move between a lowered position in which the user can sit down on the support and a raised position in which one end of the arm abuts against the user's back;

wherein the arm is suitable for rotating with respect to the support;

wherein the arm is operatively associated with a rotating actuator; and wherein the arm is associated with a splined shaft and a gear which can be caused to rotate by the actuator.

14. Seat for amusement apparatus comprising a support and means for immobilizing the user on the support, wherein the immobilizing means are suitable for leaving the passenger's shoulders free and immobilizing him through an abdominal or thoracic portion and wherein the support is shaped so as to receive the passenger astride the seat;

wherein the immobilizing means comprise at least one frontal support with respect to a user and opposing means designed to act on the user's back;

wherein the opposing means comprises an arm which can move between a lowered position in which the user can sit down on the support and a raised position in which one end of the arm abuts against the user's back; and wherein the arm is operatively associated with means for controlling position.

15. Seat according to claim 14, in which the means for controlling position comprise a cam which moves with respect to a microswitch.

16. Seat for amusement apparatus comprising a support and means for immobilizing the user on the support, wherein the immobilizing means are suitable for leaving the passenger's shoulders free and immobilizing him through an abdominal or thoracic portion and wherein the support is shaped so as to receive the passenger astride the seat;

wherein the immobilizing means comprise at least one frontal support with respect to a user and opposing means designed to act on the user's back;

wherein the opposing means comprises an arm which can move between a lowered position in which the user can sit down on the support and a raised position in which one end of the arm abuts against the user's back; and wherein the arm is operatively associated with means for immobilizing it in the raised position.

17. Seat according to claim 16, in which the means for immobilizing in the raised position comprise a toothed wheel associated with the arm and a rack can be moved between the position in which it is suitable for meshing with the toothed wheel in the raised position of the arm and a position in which the toothed wheel is free to rotate.

18. Seat for amusement apparatus comprising a support and means for immobilizing the user on the support, wherein the immobilizing means are suitable for leaving the passenger's shoulders free and immobilizing him through an abdominal or thoracic portion and wherein the support is shaped so as to receive the passenger astride the seat;

wherein the immobilizing means comprise at least one frontal support with respect to a user and opposing means designed to act on the user's back; and wherein the opposing means is suitable for rotating with respect to the support.

19. A seat for an amusement apparatus, comprising:

(a) a rider support including:

(i) a seat portion; and (ii) a front portion situated higher than the seat portion and angled such that a rider sitting astride on the seat portion must lean forward into a forward leaning posture for at least one of the rider's abdominal and thoracic regions to contact the front portion of the rider support; and (b) a restraint moveable between a first position not contacting the rider in the forward leaning posture and a second position wherein at least a portion of the restraint contacts at least a back portion of the rider in the forward leaning posture and configured to maintain the rider in said forward leaning posture.

20. The seat of claim 19, wherein the restraint is pivotable between the first and second positions.

21. The seat of claim 20, wherein the restraint includes an arm and an opposing portion connected to the arm arranged to abut the riders back when the restraint is in the second position and the rider is in the forward leaning posture.

22. The seat of claim 21, further comprising a lock configured to immobilize the arm when the restraint is in the second position and the rider is in the forward leaning posture.

23. The seat of claim 19, wherein at least one of the front portion and the restraint include side portions arranged to at least partially wrap around a side of the rider.

24. The seat of claim 19, wherein the restraint does not restrain rider's shoulders.

25. The seat of claim 19, wherein the rider support is supported by a frame connected to a floor of the amusement apparatus.

26. The seat of claim 25, wherein the restraint is pivotally connected to the frame.

27. The seat of claim 25, wherein the frame includes a frontal support member arranged at an angle to the floor and a support portion connected to one end of the frontal support member at an angle to the frontal support member.

28. The seat of claim 27, wherein the front portion of the rider support is connected to the support portion of the frame.

29. The seat of claim 27, wherein the frame includes at least one lateral support member connected to the floor on one end and the frontal support member at an opposite end.

30. The seat of claim 25, further comprising a casing that at least partially covers the frame.

31. The seat of claim 19, wherein the front portion of the rider support is movably mounted on the seat such that a position of the front portion is adjustable according to a rider's dimensions.

32. The seat of claim 19, wherein the seat is adapted to be mounted on a platform of the amusement apparatus configured to move on at least one track.

33. The seat of claim 32, wherein the track has a U-shape.

34. The seat of claim 32, wherein the platform is circular.

35. The seat of claim 34, wherein the seat is arranged on at least one peripheral portion of the platform.

36. The seat of claim 35, wherein the seat is arranged such that the rider faces outwardly away from the platform.

37. The seat of claim 32, wherein the platform is configured to rotate relative to the track.

38. A seat for an amusement apparatus, comprising:

(a) a rider support including:

(i) a seat portion; and (ii) a front portion situated higher than the seat portion and angled such that a rider sitting astride on the seat portion must lean forward into a forward leaning posture for at least one of the rider's abdominal and thoracic regions to contact the front portion of the rider support; and (b) a restraint moveable between a first position not contacting the rider in the forward leaning posture and a second position wherein at least a portion of the restraint contacts at least a back portion of the rider in the forward leaning posture and configured to maintain the rider in said forward leaning posture;

wherein the restraint is operatively associated with one of a rotating actuator and a linear actuator.

39. A seat for an amusement apparatus, comprising:

(a) a rider support including:

(i) a seat portion; and (ii) a front portion situated higher than the seat portion and angled such that a rider sitting astride on the seat portion must lean forward into a forward leaning posture for at least one of the rider's abdominal and thoracic regions to contact the front portion of the rider support; and (b) a restraint moveable between a first position not contacting the rider in the forward leaning posture and a second position wherein at least a portion of the restraint contacts at least a back portion of the rider in the forward leaning posture and configured to maintain the rider in said forward leaning posture;

wherein the restraint includes an arm and an opposing portion connected to the arm arranged to abut the riders back when the restraint is in the second position and the rider is in the forward leaning posture;

wherein the restraint is pivotable between the first and second positions; and wherein the arm is operatively associated with a splined shaft and a gear rotatable by one of a rotating actuator and a linear actuator.

40. A seat for an amusement apparatus, comprising:

(a) a rider support including:

(i) a seat portion; and (ii) a front portion situated higher than the seat portion and angled such that a rider sitting astride on the seat portion must lean forward into a forward leaning posture for at least one of the rider's abdominal and thoracic regions to contact the front portion of the rider support; and (b) a restraint moveable between a first position not contacting the rider in the forward leaning posture and a second position wherein at least a portion of the restraint contacts at least a back portion of the rider in the forward leaning posture and configured to maintain the rider in said forward leaning posture;

wherein the restraint is pivotable between the first and second positions;

wherein the restraint includes an arm and an opposing portion connected to the arm arranged to abut the riders back when the restraint is in the second position and the rider is in the forward leaning posture; and wherein the arm is operatively associated with a splined shaft having a cam connected thereto, the cam configured to trigger a switch when the restraint is moved to a predetermined position.

41. The seat of claim 40, wherein the switch includes a runner arm having a wheel rotatably connected to one end, and wherein a profile of the cam is configured to move with respect to the wheel to cause the runner arm to rotate about a switch hinge point.

42. The seat of claim 41, wherein the cam is circular and includes a first radius over a portion of the cam profile and a second smaller radius over another portion of the cam profile.

43. A seat for an amusement apparatus, comprising:

(a) a rider support including:

(i) a seat portion; and (ii) a front portion situated higher than the seat portion and angled such that a rider sitting astride on the seat portion must lean forward into a forward leaning posture for at least one of the rider's abdominal and thoracic regions to contact the front portion of the rider support;

(b) a restraint moveable between a first position not contacting the rider in the forward leaning posture and a second position wherein at least a portion of the restraint contacts at least a back portion of the rider in the forward leaning posture and configured to maintain the rider in said forward leaning posture; and (c) a lock configured to immobilize the arm when the restraint is in the second position and the rider is in the forward leaning posture;

wherein the restraint is pivotable between the first and second positions;

wherein the restraint includes an arm and an opposing portion connected to the arm arranged to abut the riders back when the restraint is in the second position and the rider is in the forward leaning posture; and wherein the lock includes a rack hinged on the frame and associated with a toothed wheel keyed on a splined shaft operatively associated with the arm.

44. The seat of claim 43, further including resilient means for keeping the toothed wheel against the rack, said resilient means disabled during a return movement of the arm from the second position to the first position.

45. The seat of claim 43, further comprising a pneumatic piston configured to keep the toothed wheel against the rack, said pneumatic piston configured to be pneumatically disabled during a return movement of the arm from the second position to the first position.

46. A seat for an amusement apparatus, comprising:

(a) a rider support including:

(i) a seat portion; and (ii) a front portion situated higher than the seat portion and angled relative to a floor of the amusement apparatus such that a rider sitting astride on the seat portion must lean forward into a forward leaning posture for at least one of the rider's abdominal and thoracic regions to contact the front portion of the rider support; and (b) opposing means moveable between a first position not contacting the rider in the forward leaning posture and a second position wherein at least a portion of the restraint contacts at least a back portion of the rider in the forward leaning posture and configured to maintain the rider in said forward leaning posture.

47. The seat of claim 46, further comprising means for checking a position of the opposing means to assure that the rider is secured.

48. The seat of claim 46, further comprising means for immobilizing the opposing means in the second position.

* * * * *

UNITED STATES PATENT AND TRADEMARK OFFICE

CERTIFICATE OF CORRECTION

PATENT NO. : 7,632,191 B2
APPLICATION NO. : 10/726830
DATED : December 15, 2009
INVENTOR(S) : Zambelli et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1616 days.

Signed and Sealed this

Second Day of November, 2010

David J. Kappos

David J. Kappos
*Director of the United States Patent and Trademark Office*